US009699834B2

(12) United States Patent
Nagata et al.

(10) Patent No.: US 9,699,834 B2
(45) Date of Patent: Jul. 4, 2017

(54) INDUCTION HEATING COOKER

(71) Applicant: Panasonic Corporation, Kadoma-shi, Osaka (JP)

(72) Inventors: Ryuuji Nagata, Hyogo (JP); Katsuyuki Aihara, Hyogo (JP); Kazuyoshi Shichi, Hyogo (JP); Takahiro Miyauchi, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 255 days.

(21) Appl. No.: 14/389,053

(22) PCT Filed: Oct. 22, 2013

(86) PCT No.: PCT/JP2013/006240
§ 371 (c)(1),
(2) Date: Sep. 29, 2014

(87) PCT Pub. No.: WO2014/064922
PCT Pub. Date: May 1, 2014

(65) Prior Publication Data

US 2015/0341990 A1 Nov. 26, 2015

(30) Foreign Application Priority Data

Oct. 22, 2012 (JP) ..... 2012-232591
May 13, 2013 (JP) ..... 2013-100943

(51) Int. Cl.
*H05B 6/12* (2006.01)
*H05B 6/06* (2006.01)

(52) U.S. Cl.
CPC ..... *H05B 6/1272* (2013.01); *H05B 6/062* (2013.01); *H05B 6/065* (2013.01);
(Continued)

(58) Field of Classification Search
CPC ..... H05B 2206/02–2206/024; H05B 2213/00–2213/07; H05B 6/062; H05B 6/065; H05B 6/12–6/1281
(Continued)

(56) References Cited

U.S. PATENT DOCUMENTS

2007/0164017 A1* 7/2007 Gouardo ..... H05B 6/065 219/626
2007/0262072 A1 11/2007 Schilling
(Continued)

FOREIGN PATENT DOCUMENTS

DE 102010031225 A1 * 2/2011
EP 2 413 659 A1 2/2012
(Continued)

OTHER PUBLICATIONS

English translation EP2440007 Apr. 2012.*
(Continued)

*Primary Examiner* — Sang Y Paik
(74) *Attorney, Agent, or Firm* — Brinks Gilson & Lione

(57) ABSTRACT

An induction heating cooker includes a top plate on which an object to be heated is placed, a plurality of heating coils disposed adjacent to one another below the top plate to generate inductive magnetic fields to heat the object to be heated, a plurality of temperature detectors operable to detect a temperature of the object to be heated; and a controller operable to control operating states of the heating coils based on detection results of the temperature detector, wherein the plurality of temperature detectors are disposed widely below the top plate, and the number of the temperature detectors is less than the number of the heating coils.

2 Claims, 9 Drawing Sheets

(52) U.S. Cl.
CPC .... *H05B 2206/022* (2013.01); *H05B 2213/03* (2013.01); *H05B 2213/05* (2013.01); *H05B 2213/07* (2013.01)

(58) Field of Classification Search
USPC ..... 219/620–627
See application file for complete search history.

(56) References Cited

U.S. PATENT DOCUMENTS

| | | | | |
|---|---|---|---|---|
| 2011/0303653 | A1* | 12/2011 | Chun | H05B 6/062 219/624 |
| 2012/0024840 | A1 | 2/2012 | Lee et al. | |

FOREIGN PATENT DOCUMENTS

| | | | |
|---|---|---|---|
| EP | 2 440 007 | A2 | 4/2012 |
| EP | 2 440 007 | A4 | 4/2012 |
| EP | 2 670 211 | A2 | 12/2013 |
| JP | 2847939 | B2 | 1/1999 |
| JP | 2008-527294 | A | 7/2008 |
| JP | 2009-099299 | A | 5/2009 |
| JP | 2009-238613 | A | 10/2009 |
| JP | 2010-170930 | A | 8/2010 |
| JP | 2010-244925 | A | 10/2010 |
| JP | 4863961 | B2 | 1/2012 |
| JP | 2012-104418 | A | 5/2012 |
| WO | WO 2006/072388 | A1 | 7/2006 |
| WO | WO 2009/001537 | A | 12/2008 |

OTHER PUBLICATIONS

English translation DE102010031225(A1) Feb. 2011.*
English translation JP2010-170930 Aug. 2010.*
International Preliminary Report on Patentability, and English language translation thereof, in corresponding International Application No. PCT/JP2013/006240, dated May 7, 2015, 13 pages.
Office Action and Search Report, and partial English language translation thereof, in corresponding Chinese Application No. 201380016753.5, dated Apr. 24, 2015, 9 pages.
International Search Report, and English translation thereof, in corresponding International Application No. PCT/JP2013/006240, dated Dec. 3, 2013, 5 pages.
Extended Search Report for corresponding European Patent Application No. 13 84 9573 dated Oct. 5, 2015, 9 pages.

* cited by examiner

INDUCTION HEATING COOKER

This application is a 371 application of PCT/JP2013/006240 having an international filing date of Oct. 22, 2013, which claims priority to JP2012-232591 filed Oct. 22, 2012 and JP2013-100943 filed May 13, 2013, the entire contents of which are incorporated herein by reference.

TECHNICAL FIELD

The present invention relates to an induction heating cooker for induction heating an object to be heated such as, for example, a metallic cooking pan placed on a top plate.

BACKGROUND ART

A conventionally known induction heating cooker has a plurality of heating coils juxtaposed to one another below the top plate to heat the object to be heated such as a cooking pan.

As shown in FIG. 11, such a conventional induction heating cooker has a plurality of cooking coils 202a-*d,* 203, 204 with respect to a heating place 201 (that is, a region above the top plate 205 to place the object to be heated such as the pan thereon) (see, for example, Patent Document 1). This induction heating cooker 200 is provided with a pan-placement discriminant portion for detecting the state of the pan placed on the top plate 205 so as to confront the heating place 201 so that the heating coils to be used may be selected from among the plurality of heating coils 202a-*d,* 203, 204 based on a detection result of the pan-placement discriminant portion for subsequent heating of the pan.

Also, as shown in FIG. 12, another induction heating cooker 300 has some individual heating units (heating coils) juxtaposed to one another and each having a regular hexagonal shape (see, for example, Patent Document 2). In this induction heating cooker 300, the state of a pan 306 placed on the top plate 305 is detected and then a whole profile of a heating region 302 formed by the plurality of heating units 301 is illuminated to thereby display the activated heating units for a user.

PATENT DOCUMENTS

Patent Document 1: JP 2012-104418 A
Patent Document 2: JP 2008-527294 A

SUMMARY OF THE INVENTION

Problems to be Solved by the Invention

In the induction heating cooker 200 of Patent Document 1, the position where the user places the object to be heated (that is, the heating place 201) is determined and, accordingly, the heating presupposes the placement of the object to be heated on the position so determined. Because of this, the induction heating cooker 200 is not configured to allow the user to freely determine the place of the object to be heated on the top plate.

In the induction heating cooker 300 of Patent Document 2, the display allows the user to see which heating units have been activated, but this induction heating cooker 300 does not have a function of controlling the heating units upon detection of the temperature of the object to be heated. Accordingly, if the user takes his or her eyes off the object to be heated during cooking, the object is likely to be heated up to an abnormally high temperature, thus resulting in an unstable state.

Also, as in Patent Document 2, if the induction heating cooker having the plurality of heating coils is provided with a temperature detector such as, for example, a temperature sensor for detecting the temperature of the object to be heated, a space where the temperature sensor is placed is limited and, hence, a close consideration is required to determine where the temperature sensor should be placed. In the induction heating cooker of this kind, however, the position of the temperature sensor has not been hitherto considered closely.

If each heating coil is provided with a temperature sensor, much space is required for placement of all the sensors, and if the sensors are placed within respective heating coils, the coil diameter increases and, hence, a lot of heating coils cannot be placed. In addition, the placement of a lot of heating coils each provided with a temperature sensor involves an increase in cost of the appliance (cooker) and is accordingly uneconomical.

The present invention has been developed to solve the conventional problems referred to above and is intended to provide an induction heating cooker having a lot of small-diameter heating coils disposed adjacent to one another and allowing a user to determine a location where an object to be heated is placed. This induction heating cooker can accurately detect the temperature of the object to be heated and enhance the safety by devising the arrangement of temperature detectors while curbing costs.

Means to Solve the Problems

In order to solve the problems inherent in the conventional art, an induction heating cooker according to the present invention comprises: a top plate on which an object to be heated is placed; a plurality of heating coils disposed adjacent to one another below the top plate to generate inductive magnetic fields to heat the object to be heated; a plurality of temperature detectors operable to detect a temperature of the object to be heated; and a controller operable to control operating states of the heating coils based on detection results of the temperature detector, wherein the plurality of temperature detectors are disposed widely below the top plate, and the number of the temperature detectors is less than the number of the heating coils. The plurality of temperature detectors may be disposed widely so that at least one of the temperature detectors is positioned below the object to be heated when the object to be heated is placed above two heating coils adjacent to each other. Alternatively, the plurality of temperature detectors may be disposed widely so that at least one temperature detector may be related to two adjacent heating coils.

Effects of the Invention

According to the present invention, in an induction heating cooker having a lot of small-diameter heating coils disposed adjacent to one another and allowing a user to determine a location where an object to be heated is placed, the temperature of the object to be heated can be accurately detected and the safety can be enhanced by devising the arrangement of temperature detectors while curbing costs.

DETAILED DESCRIPTION OF THE PREFERRED EMBODIMENTS

Figure 1:
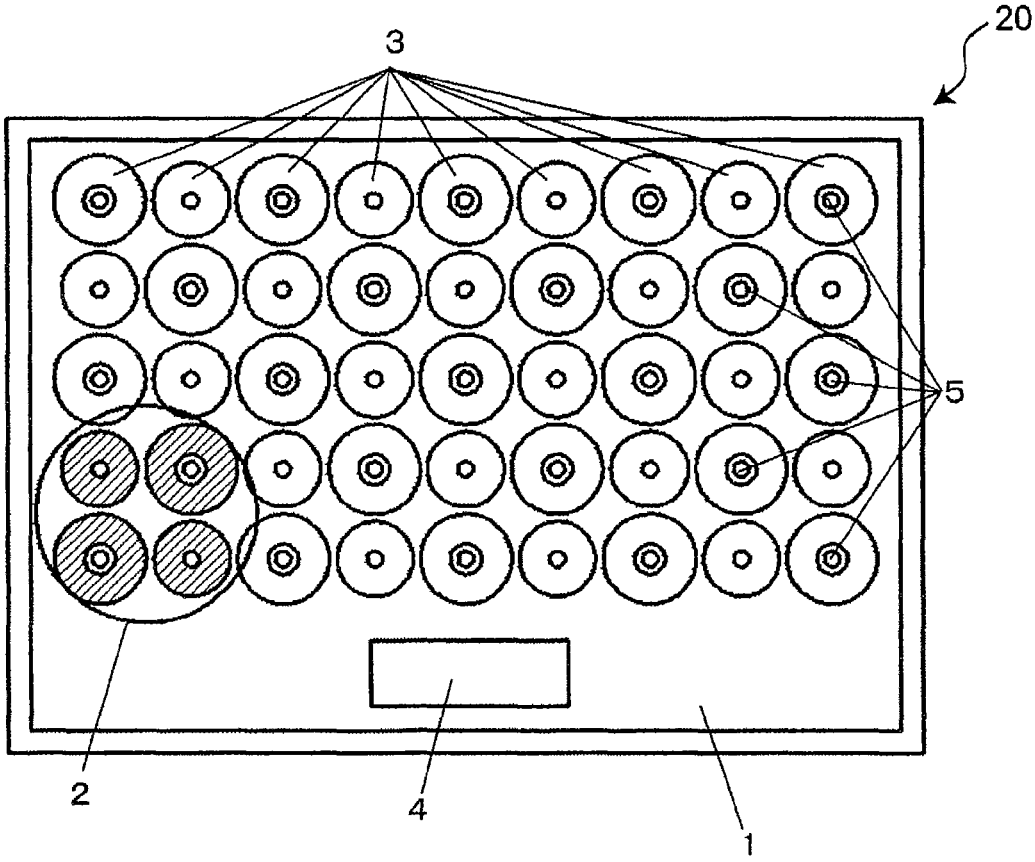
FIG. 1 is a top plan view of an induction heating cooker according to a first embodiment of the present invention as viewed from an upper surface of a top plate on which an object to be heated is placed, showing an arrangement of a number of heating coils and a number of infrared sensors.

An induction heating cooker according to the first invention comprises: a top plate on which an object to be heated is placed; a plurality of heating coils disposed adjacent to one another below the top plate to generate inductive magnetic fields to heat the object to be heated; a plurality of temperature detectors operable to detect a temperature of the object to be heated; and a controller operable to control operating states of the heating coils based on detection results of the temperature detector, wherein the plurality of temperature detectors are disposed widely below the top plate, and the number of the temperature detectors is less than the number of the heating coils.

According to this configuration, in the induction heating cooker having the plurality of heating coils disposed adjacent to one another and allowing a user to determine a location where the object to be heated is placed, not only can the number of the temperature detectors be made less than that of the heating coils to curb costs, but the plurality of temperature detectors can be also disposed widely to accurately detect the temperature of the object to be heated and enhance the safety.

The plurality of temperature detectors may be disposed widely so that at least one of the temperature detectors is positioned below the object to be heated when the object to be heated is placed above two heating coils adjacent to each other. This configuration can reduce the number of the temperature detectors compared with that of the heating coils. The temperature of the object to be heated can be accurately detected using the temperature detector positioned below the object to be heated when the object to be heated is placed above two heating coils adjacent to each other, thereby making it possible to achieve a balance between a reduction in costs and enhancement in safety.

Alternatively, the plurality of temperature detectors may be disposed widely so that at least one temperature detector may be related to two adjacent heating coils. This configuration can reduce the number of the temperature detectors compared with that of the heating coils and unfailingly detect the temperature of the object to be heated using the temperature detector that has been related to the two adjacent heating coils, thereby making it possible to achieve a balance between a reduction in costs and enhancement in safety.

In the induction heating cooker according to the first invention, the second invention is characterized in that each of the heating coils has a circumferential length within a range of a circumferential length of a circle having an external diameter that ranges from 35 mm to 67 mm. According to this configuration, even if any of various pans employed as the object to be heated is placed on an arbitrary position of the top plate for subsequent induction heating, a desirable heating efficiency can be obtained while reducing uneven heating of the pan.

In the induction heating cooker according to the first or second invention, the third invention is characterized in that the temperature detectors are each mounted to a central portion of one of the heating coils, but at least one of the heating coils has no temperature detector. According to this configuration, not only can the central portions of the heating coils be utilized as installation spaces for the temperature detectors, but the coil diameter of the heating coil having no temperature detector at the central portion can be also reduces and, according, uneven heating of the object to be heated can be reduced.

In the induction heating cooker according to the third invention, the fourth invention is characterized in that the plurality of heating coils are arrayed in a plurality of directions crossing each other and the temperature detectors are mounted to alternate heating coils in one of the plurality of directions. This configuration can considerably reduce the number of the temperature detectors compared with that of the heating coils and allows the temperature detectors to be disposed widely at regular intervals, thereby making it possible to accurately detect the temperature of the object to be heated irrespective of the location of placement of the object to be heated.

In the induction heating cooker according to the first or second invention, the fifth invention is characterized in that the temperature detectors are positioned only outside the plurality of heating coils. According to this configuration, because the temperature detectors are not positioned at the central portions of the heating coils and the coil diameter can be accordingly reduced, uneven heating of the object to be heated can be reduced.

In the induction heating cooker according to the first or second invention, the sixth invention is characterized in that each of the temperature detectors is disposed among at least three adjacent heating coils. According to this configuration, because the temperature detectors can be placed by making use of dead spaces created when the plurality of heating coils are arrayed, a limited space can be efficiently utilized and, also, the coil diameter of the heating coils can be reduced to thereby reduce uneven heating.

In the induction heating cooker according to the sixth invention, the seventh invention is characterized in that each of the temperature detectors is disposed at a location equally spaced from the at least three adjacent heating coils. According to this configuration, each temperature detector can be related to the three heating coils and the temperature of the object to be heated placed above any of the three heating coils can be accurately detected by the related temperature detector.

In the induction heating cooker according to the sixth invention, the eighth invention is characterized in that each of the temperature detectors is disposed at a remove from a location equally spaced from the at least three adjacent heating coils. According to this configuration, each temperature detector can be related to the nearest heating coil of the three heating coils and the temperature of the object to be heated can be accurately detected using the temperature detector related to the heating coil on which the object to be heated has been placed.

In the induction heating cooker according to the first or second invention, the ninth invention is characterized in that each of the temperature detectors is disposed between two adjacent heating coils. According to this configuration, each temperature detector can be related to the two adjacent heating coils and the temperature of the object to be heated can be accurately detected using the temperature detector related to the heating coils.

Embodiments of the present invention are described hereinafter with reference to the drawings, but the present invention is not limited by the embodiments.

Embodiment 1

Figure 2:
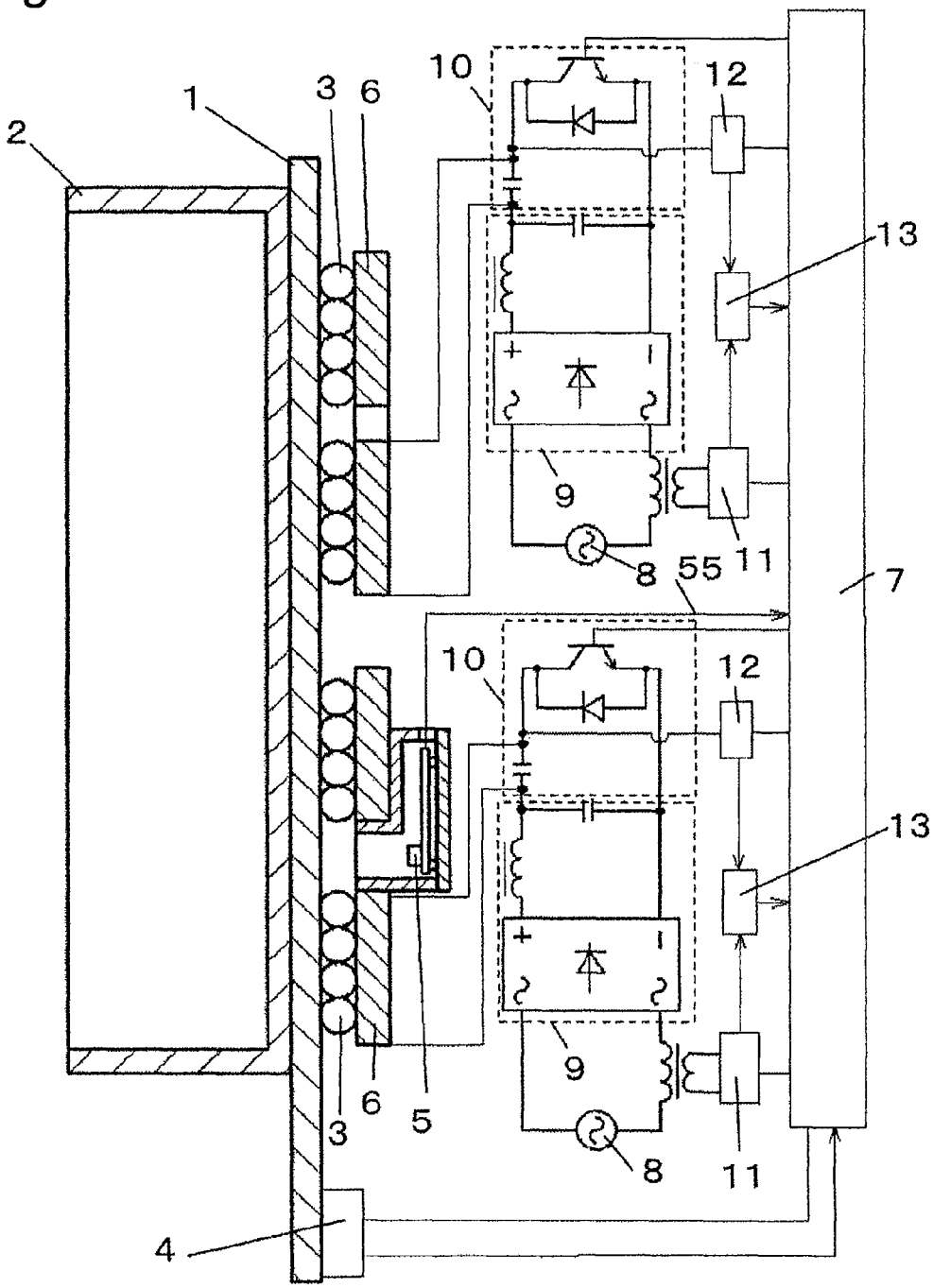
FIG. 2 is a block diagram showing a partial cross-sectional configuration and a circuit configuration of the induction heating cooker according to the first embodiment.
Figure 3:
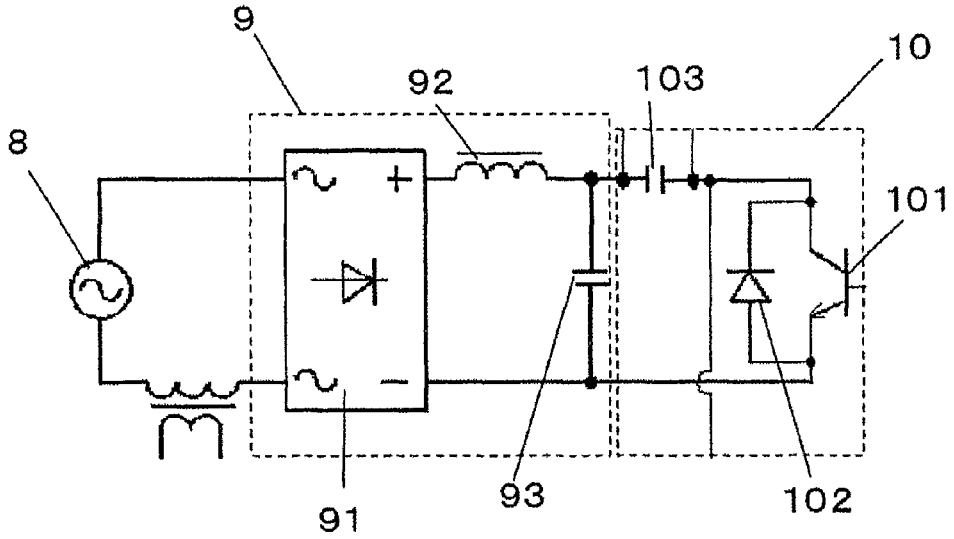
FIG. 3 is a circuit diagram of a rectifying and smoothing portion and an inverter circuit of the induction heating cooker according to the first embodiment.
Figure 4:
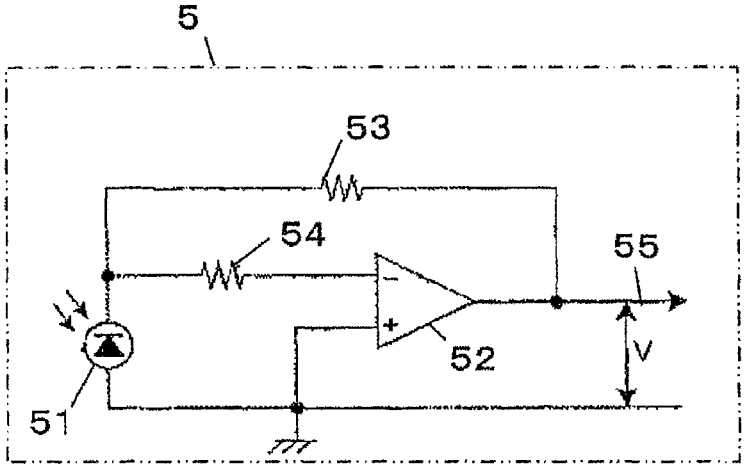
FIG. 4 is a circuit diagram of an infrared sensor of the induction heating cooker according to the first embodiment.

FIG. 1 is a top plan view of an induction heating cooker according to a first embodiment of the present invention as viewed from an upper surface of a top plate on which an object to be heated is placed, showing an arrangement of a number of heating coils and a number of infrared sensors employed as an example of a temperature detector. FIG. 2 is a block diagram showing a partial cross-sectional configuration and a circuit configuration of the induction heating cooker according to the first embodiment. FIG. 3 is a circuit diagram of a rectifying and smoothing portion and an inverter circuit of the induction heating cooker according to the first embodiment and FIG. 4 is a circuit diagram of an infrared sensor of the induction heating cooker according to the first embodiment.

The induction heating cooker 20 according to the first embodiment is used by being incorporated into a cabinet of, for example, a kitchen. The induction heating cooker 20 is provided with a top plate 1 mounted on an upper surface of the cooker and a plurality of heating coils 3 for induction heating an object to be heated 2 placed on the top plate 1 by generating high-frequency magnetic fields.

The top plate 1 is formed of an electrical insulating medium such as, for example, a nearly transparent and light transmissive crystallized glass to transmit infrared rays. Each of the heating coils 3 is a spiral coil (circular coil) disposed below the top plate 1 in the form of a doughnut having a hole defined roughly in the center thereof.

The plurality of heating coils 3 disposed below the top plate 1 are closely and linearly arrayed in each of the longitudinal and transverse directions.

In the induction heating cooker 20, for example, nine columns of heating coils and five rows of heating coils are respectively arrayed in the longitudinal direction and in the transverse direction.

An operation display 4 is provided on the user side (front side) of the top plate 1 to allow a user to give instructions, for example, to start and stop the heating by the heating coils 3.

In this first embodiment, an infrared sensor 5 is employed as an example of a temperature detector for detecting the temperature of the object to be heated 2 placed on the top plate 1. The infrared sensor 5 has a function of detecting the temperature of the object to be heated 2 by receiving infrared rays that change in the amount of energy depending on the temperature of the object to be heated 2. The infrared sensor 5 is screwed to a heating coil holder 6 at a location below the center of the heating coil 3 so as to monitor through the hole formed in the central portion of the heating coil 3. The infrared sensor 5 is integrated with the heating coil to form a heating coil unit.

A plurality of heating coil units are disposed in such a manner that the infrared sensors 5 are mounted to alternate heating coils 3 in each of the longitudinal and transverse directions.

Other heating coils 3, i.e., other alternate heating coils 3 have no infrared sensor 5. Accordingly, the heating coils 3 having no infrared sensor 5 can have a center hole of a reduced diameter, thus making it possible to make the external diameter of the heating coils 3 having no infrared sensor 5 smaller than that of the heating coils 3 each having an infrared sensors 5.

As shown in FIG. 4, each infrared sensor 5 includes an infrared detecting element 51, an operational amplifier 52 and two resistors 53, 54. One end of each of the resistors 53, 54 is connected to the infrared detecting element 51 and the other ends of the resistors 53, 54 are connected to an output terminal and an inverted output terminal of the operational amplifier 52, respectively.

The infrared detecting element 51 is a light receiving element for allowing an electric current to flow therethrough when it is irradiated with infrared rays that have passed through the top plate 1. An electric current generated by the infrared detecting element 51 is amplified by the operational amplifier 52 and outputted to a controller 7 (described later) as an infrared detection signal 55 (corresponding to a voltage value V) indicating the temperature of the object to be heated 2.

As shown in FIG. 2, a rectifying and smoothing portion 9 for converting an alternating-current voltage supplied from a commercially available power source 8 into a direct-current voltage and an inverter circuit 10 for generating a high-frequency current, when supplied with the direct-current voltage from the rectifying and smoothing portion 9, to output the generated high-frequency current to an associated one of the heating coils 3 are disposed below the associated heating coil 3.

An input current detector 11 for detecting an input current that flows from the commercially available power source 8 to the rectifying and smoothing portion 9 is provided between the commercially available power source 8 and the rectifying and smoothing portion 9.

As shown in FIG. 3, the rectifying and smoothing portion 9 includes a full-wave rectifier 91 made up of a bridge diode and a low-pass filter made up of a choke coil 92 and a smoothing capacitor 93 connected to each other between output terminals of the full-wave rectifier 91.

The inverter circuit 10 includes a switching element 101 (an IGBT in this embodiment), a diode 102 connected in inverse-parallel with the switching element 101, and a resonance capacitor 103 connected in parallel with the heating coil 3.

When the switching element 101 of the inverter circuit 10 is turned on and off, a high-frequency current is generated. The inverter circuit 10 and the heating coil 3 constitute a high-frequency inverter.

The induction heating cooker 20 also includes a controller 7 (see FIG. 2) for controlling the high-frequency current supplied from the inverter circuit 10 to the heating coil 3 by on-off controlling the switching element 101 of the inverter circuit 10.

The controller 7 starts and stops heating based on a signal sent from the operation display 4. The operation display 4 displays information based on a signal sent from the controller 7 to communicate to the user, thereby urging the user to operate the cooker.

Also, the induction heating cooker 20 includes, for each heating coil 3, a resonance voltage detector 12 for detecting a resonance voltage of the inverter circuit 10 and an object detector 13 for determining whether or not an object to be heated 2 has been placed based on a detection value of the input current detector 11 and that of the resonance voltage detector 12.

The impedance of the heating coil 3 changes depending on the presence or absence of the object to be heated 2 and the size of the object 2 placed above the heating coil 3 and, hence, the amount of electric current flowing through the inverter circuit 10 changes, followed by a change in resonance voltage.

An ON time of the switching element 101 is controlled so that the detection value detected by the input current detector 11 may become a predetermined value. An increase in ON time of the switching element 101 causes an increase in current flowing through the heating coil 3, thus leading to an increase in resonance voltage generated by the heating coil 3 and the resonance capacitor 103.

A determination is made as to whether an object to be heated 2 is present or absent above each heating coil 3 by causing a detection current to flow through the heating coil 3 and by comparing the detection current with a threshold value set by the object detector 13 based on a change in resultant detection value. If the object detector 13 determines that the object to be heated 2 has been placed above the corresponding heating coil 3, a detection signal is outputted to the controller 7.

In the induction heating cooker 20 according to the first embodiment, the case where the object to be heated 2 is detected using the resonance voltage is taken as an example, but the method of detecting the object to be heated is not limited to the use of the resonance voltage. By way of example, a method of detecting the object to be heated 2 using a coil current may be employed.

Infrared rays emitted from a bottom surface of the object to be heated 2 and indicating the bottom temperature of the object to be heated 2 enter through the top plate 1 and are received by the infrared sensor 5, which in turn detects the received infrared rays and outputs an infrared detection signal obtained from the detected infrared rays to the controller 7.

The controller 7 controls the switching element 101 to turn it on or off based on the infrared rays detected by the infrared sensor 5 to control the heating of the object to be heated 2 by the heating coil 3.

The operation and function of the induction heating cooker 20 of the above-configuration according to the first embodiment are explained hereinafter.

When the user powers the induction heating cooker 20 on and places an object to be heated 2 on an arbitrary position of the top plate 1, a detecting operation of the object to be heated 2 is performed by the controller 7. Specifically, a weak detection signal is caused to flow through all the heating coils 3 of the induction heating cooker 20 and the object detectors 13 subsequently detect whether or not the object to be heated 2 has been placed above the respective heating coils 3, based on changes obtained by the input current detectors 11 and the resonance voltage detectors 12, to output respective detection signals to the controller 7.

The heating coils having respective infrared sensors 5 are registered in a microcomputer of the controller 7 in advance (that is, information that relates the infrared sensors 5 to the heating coils 3, each of which has been registered as having an infrared sensor 5, is registered). If the controller 7 determines, based on the registered information, that an object to be heated 2 has been placed on a location substantially above two or more adjacent heating coils 3 and that an infrared sensor 5 is present below a central portion of at least one of the two or more adjacent heating coils 3, the operation display 4 displays a message that the object to be heated 2 has been placed and the heating can be started to urge the user to start heating.

When the user performs a heating start operation, high-frequency magnetic fields are generated by a plurality of heating coils 3 located below the object to be heated 2 so that the object to be heated 2 may be heated by eddy currents caused by the high-frequency magnetic fields. When the temperature of the object to be heated 2 is increased by the heating, infrared rays of an amount of energy corresponding to the temperature are emitted from a bottom surface of the object to be heated 2.

In general, the infrared energy emitted from an object is determined by the temperature of the object and also increases and is extended on a short-wavelength side with an increase in temperature. In this first embodiment, the crystallized glass used for the top plate 1 can transmit 90% or more of the infrared energy in, for example, a wavelength range of 0.5-2.5 μm.

In the first embodiment, the infrared detecting element 51 is made up of, for example, an Si photodiode having a peak sensitivity at about 950 nm. If the bottom surface temperature of the object to be heated 2 exceeds 250° C., the infrared radiant energy of a wavelength range of about 1 μm enters the infrared sensor 5. When an infrared detection signal 55 obtained from the infrared rays detected by the infrared sensor 5 is inputted to the controller 7, the controller 7 computes a detection temperature. This is because the input energy to the infrared detecting element 51 contributes to the emissivity represented by Planck's law.

Accordingly, if the object to be heated 2 such as, for example, a pan reaches a high temperature of, for example, 250° C., the temperature of the pan can be accurately detected, thus making it possible to curb an abnormal temperature increase. The Si photodiode used for the infrared detecting element 51 is less expensive than, for example, an InGaAs, which is sensitive at long wavelengths, and useful as a sensor that is limited to an overtemperature protecting function.

As described above, in the induction heating cooker 20 according to the first embodiment, if a determination is made that an object to be heated 2 has been placed on a location substantially above two or more adjacent heating coils 3 and that an infrared sensor 5 is present below a central portion of at least one of the two or more adjacent heating coils 3, the controller 7 controls the operation display 4 to display a message indicating that the start of heating is possible, thereby informing the user of the fact that the heating can be started. When the user performs a heating start operation, the object to be heated 2 is heated and infrared rays emitted from the bottom surface of the object to be heated 2 and having transmitted the top plate 1 are detected by at least one infrared sensor 5 located below the object to be heated 2. If the controller 7 determines that the object to be heated 2 has reached a high temperature of 250° C. based on an infrared detection result that changes with a temperature increase of the object to be heated 2, the controller 7 stops heating so as to avoid the object to be heated 2 from continuing an abnormal temperature increase, thereby making it possible to enhance the safety.

Also, the infrared sensor 5 is integrated with the heating coil 3 to form a heating coil unit by screwing the infrared sensor 5 to a heating coil holder 6 so as to monitor from a nearly central portion of the heating coil 3. By this configuration, if the object to be heated 2 has been placed above the heating coil unit, the object to be heated 2 can be regarded as having been unfailingly placed above both the heating coil 3 and the infrared sensor 5. Also, the temperature of a bottom portion of the object to be heated 2 immediately above the heating coil 3 where the temperature increases most quickly can be detected by the infrared sensor 5 at the nearly central portion of the heating coil 3, thus making it possible to highly sensitively and accurately detect the temperature of the object to be heated 2 for control of the heating operation.

Also, because abnormal heating of the object to be heated 2 can be sensitively and unfailingly detected, the heating can be more quickly stopped to thereby enhance the safety.

Further, a configuration is employed in which a plurality of heating coils 3 each having an infrared sensor 5 are alternately disposed in each of the longitudinal and transverse directions, and other alternate heating coils 3 have no infrared sensor 5. Accordingly, in a configuration in which an object to be heated 2 is heated by at least two adjacent heating coils 3, a heating coil 3 having an infrared sensor 5 can be inevitably positioned below the object to be heated 2.

This configuration allows the object to be heated 2 to be placed above both the plurality of heating coils 3 and the infrared sensor 5 and, hence, the temperature of the object to be heated 2, which increases by being heated by the heating coils 3, can be sensitively and accurately detected while reducing the number of the infrared sensors 5. Accordingly, not only can the temperature of the object to be heated 2 be accurately controlled, but the object to be heated 2 can be also avoided from being abnormally heated, thus making it possible to enhance the safety.

Also, because the number of installation of the infrared sensors 5 can be reduced, the space of the whole appliance can be effectively utilized. Further, the heating coils 3 having no infrared sensor 5 require no central hole and can be accordingly formed into a reduced diameter, thus resulting in a more compact appliance as a whole.

In addition, a reduction in number of installation of the infrared sensors 5 leads to a reduction in appliance cost. Also, the use of the infrared sensor 5 as the temperature detector makes it possible to detect the temperature of the object to be heated 2 as an infrared energy more rapidly than a heat conduction type temperature detecting thermistor. Accordingly, the object to be heated 2 can be avoided from being abnormally heated to thereby enhance the safety. A temperature detecting thermistor may be employed as the temperature detector in place of the infrared sensor.

Embodiment 2

Figure 5:
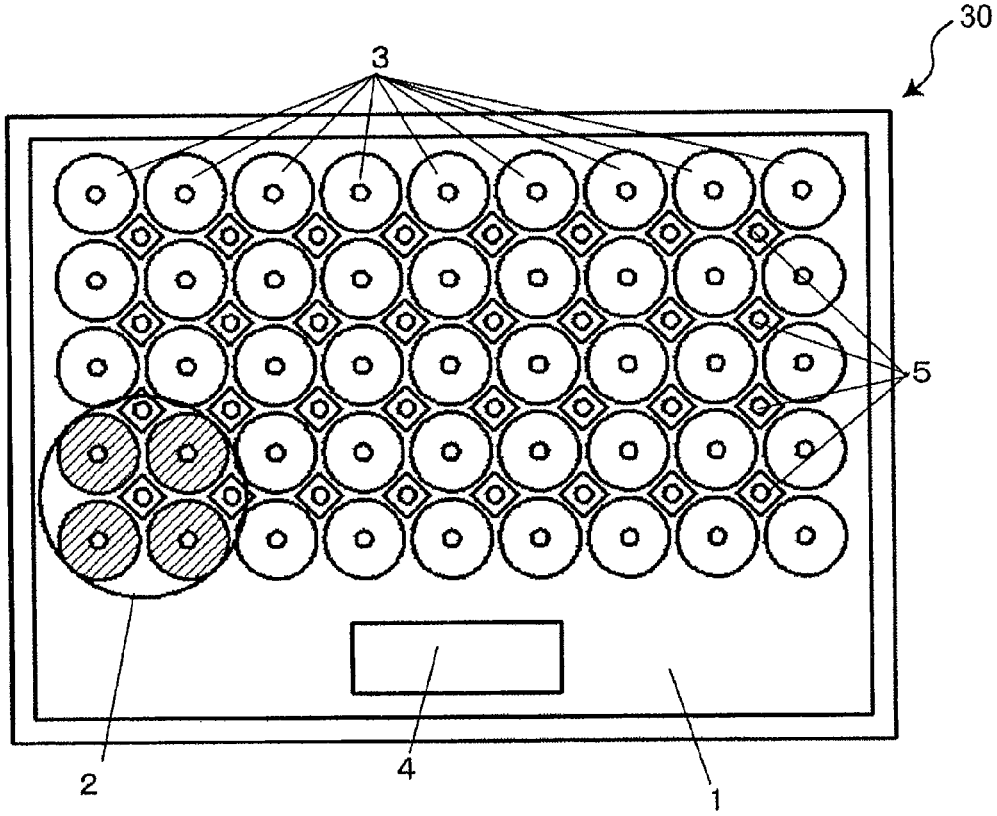
FIG. 5 is a top plan view of an induction heating cooker according to a second embodiment of the present invention as viewed from an upper surface of a top plate on which an object to be heated is placed, showing an arrangement of a number of heating coils and a number of infrared sensors.
Figure 6:
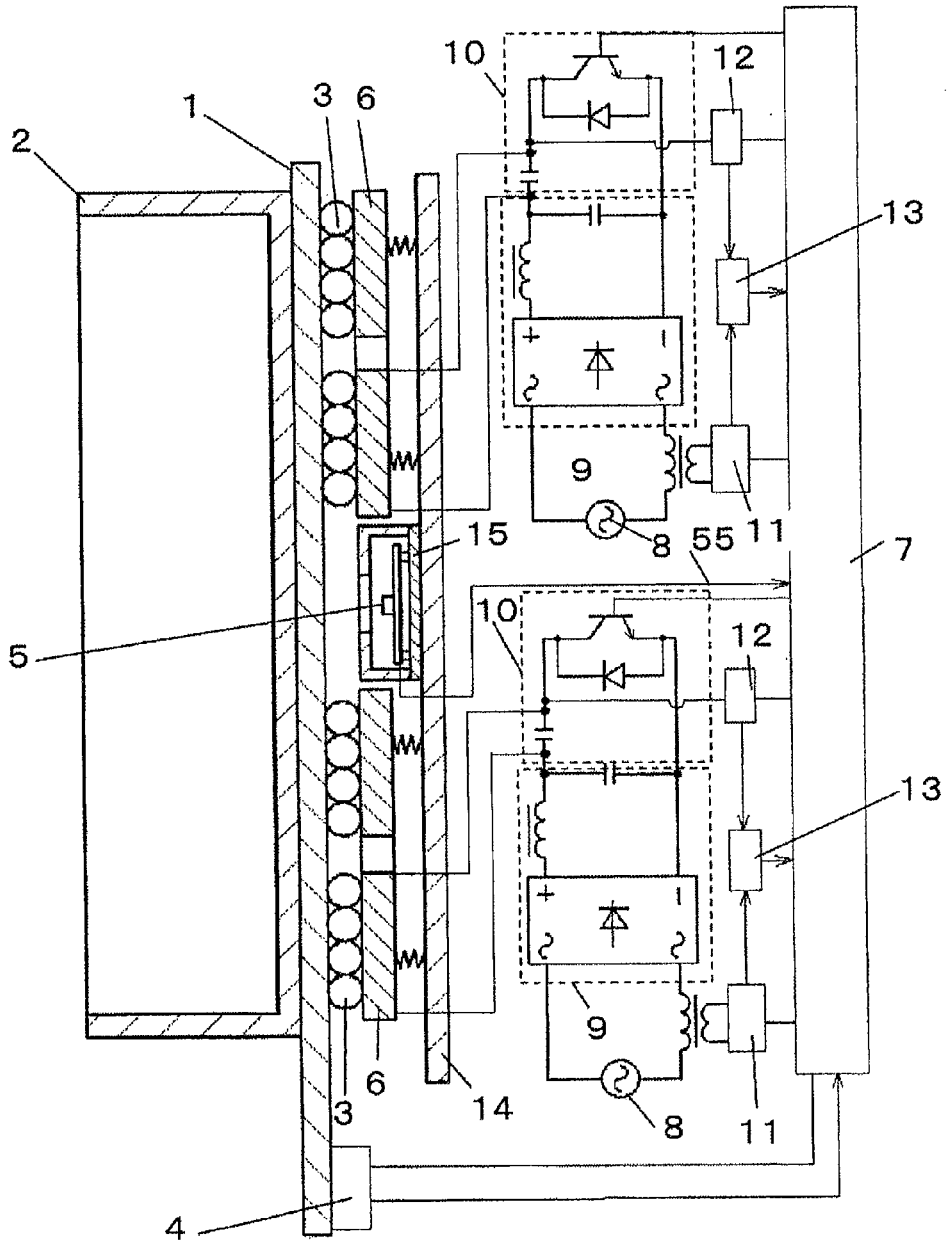
FIG. 6 is a block diagram showing a partial cross-sectional configuration and a circuit configuration of the induction heating cooker according to the second embodiment.

FIG. 5 is a top plan view of an induction heating cooker according to a second embodiment of the present invention as viewed from an upper surface of a top plate on which an object to be heated is placed, showing an arrangement of a number of heating coils and a number of infrared sensors employed as an example of a temperature detector. FIG. 6 is a block diagram showing a partial cross-sectional configuration and a circuit configuration of the induction heating cooker according to the second embodiment.

The induction heating cooker 30 according to the second embodiment differs from the induction heating cooker 20 according to the first embodiment referred to above in that each infrared sensor 5 is not located below the center of a heating coil 3, but located lateral to and between adjacent heating coils 3. In the induction heating cooker 30 according to the second embodiment, the same component parts as those in the induction heating cooker 20 according to the first embodiment are designated by the same signs and explanation thereof is omitted.

As shown in FIG. 5, the induction heating cooker 30 according to the second embodiment is provided with a plurality of heating coils 3 disposed below the top plate 1 so as to be linearly arrayed in each of the longitudinal and transverse directions. In this induction heating cooker 30, for example, nine columns of heating coils 3 and five rows of heating coils 3 are closely arrayed in the longitudinal direction and in the transverse direction, respectively. An infrared sensor 5 is disposed on an intersection of two lines that diagonally connect four adjacent heating coils 3, two columns of which are arrayed in the longitudinal direction and two rows of which are arrayed in the transverse direction. All the infrared sensors 5 are mounted on respective holders 15, each of which is mounted on a heating coil support 14.

Each heating coil 3 is a spiral coil (circular coil) of a diameter that has been reduced by minimizing a hole defined roughly in the center thereof. The heating coil 3 is held by a heating coil holder 6 and supported by a plurality of springs disposed below the heating coil holder 6. Each holder 15 having an infrared sensor 5 mounted thereon is in the form of a rhomboid (or a square) and also serves to regulate the positions of adjacent heating coils 3 each supported by the springs. The supporting manner of the heating coils 3 is not limited to the support by the springs and may be the supporting manner as set forth in the first embodiment.

As described above, the induction heating cooker 30 according to the second embodiment is provided with a plurality of heating coils 3 that are selectively determined by a user to place an object to be heated 2 thereon in such a manner that the object to be heated 2 is placed on a position substantially above two or more adjacent heating coils 3 so as to be heated by such heating coils 3. In such a configuration, because each infrared sensor 5 is positioned between adjacent heating coils 3, the object to be heated 2 can be placed above both the heating coils 3 and the infrared sensor 5. In particular, one infrared sensor 5 is disposed for every four heating coils 3 adjacent to one another in the longitudinal and transverse directions and also disposed on an intersection of two lines that diagonally connect the four heating coils 3. Accordingly, the one infrared sensor 5 is disposed in proximity to two adjacent heating coils 3, thus making it possible to control the temperature of the object to be heated 2 while detecting the temperature of the object to be heated 2 placed above the two or more adjacent heating coils 3 using the infrared sensor 5 disposed in proximity thereto. Also, the object to be heated 2 can be avoided from being abnormally heated to thereby enhance the safety.

Also, the number of installation of the infrared sensors 5 can be reduced rather than mounting an infrared sensor 5 to each of the heating coils 3. Further, by providing an infrared sensor 5 on an intersection of two lines that diagonally connect four adjacent heating coils 3, two columns of which are arrayed in the longitudinal direction and two rows of which are arrayed in the transverse direction, the heating coils 3 and the infrared sensor 5 can be tightly arrayed while effectively utilizing a dead space between the circular coils, thus making it possible to make the whole appliance compact. In addition, because the number of installation of the infrared sensors 5 can be reduced, the appliance cost can be also reduced.

Also, the holder 15 for mounting the infrared sensor 5 thereon is in the form of a rhomboid (or a square) and can regulate the positions of adjacent heating coils 3 each supported by the springs. Because of this, the distance between the heating coils 3 and the infrared sensor 5 is made constant without becoming long and, accordingly, the temperature of the object to be heated 2 that is likely to increase at a location above each heating coil 3 can be stably and accurately detected by the infrared sensor 5. As a result, the object to be heated 2 can be avoided from being abnormally heated to thereby enhance the safety.

Also, the four heating coils 3 adjacent to one another in the longitudinal and transverse directions are related to the infrared sensor 3 disposed on an intersection of two lines that diagonally connect those heating coils 3, and related information is registered in the controller 7 in advance. The controller 7 makes use of the infrared sensor 5 related to the heating coils 3 for temperature control, thereby making it possible to accurately detect the temperature of the object to be heated 2 using the infrared sensor 5 positioned in proximity to the heating coils 3. In the second embodiment, the case where one infrared sensor 5 is related to four heating coils 3 adjacent to one another in the longitudinal and transverse directions and utilized for temperature control has been explained, but the number of the heating coils 3 to be related is not limited to only such a case. If at least one infrared sensor is related to two adjacent heating coils, the heating control can be performed using the at least one infrared sensor positioned in proximity to and related to the two adjacent heating coils in heating the object to be heated using such heating coils.

Embodiment 3

Figure 7:
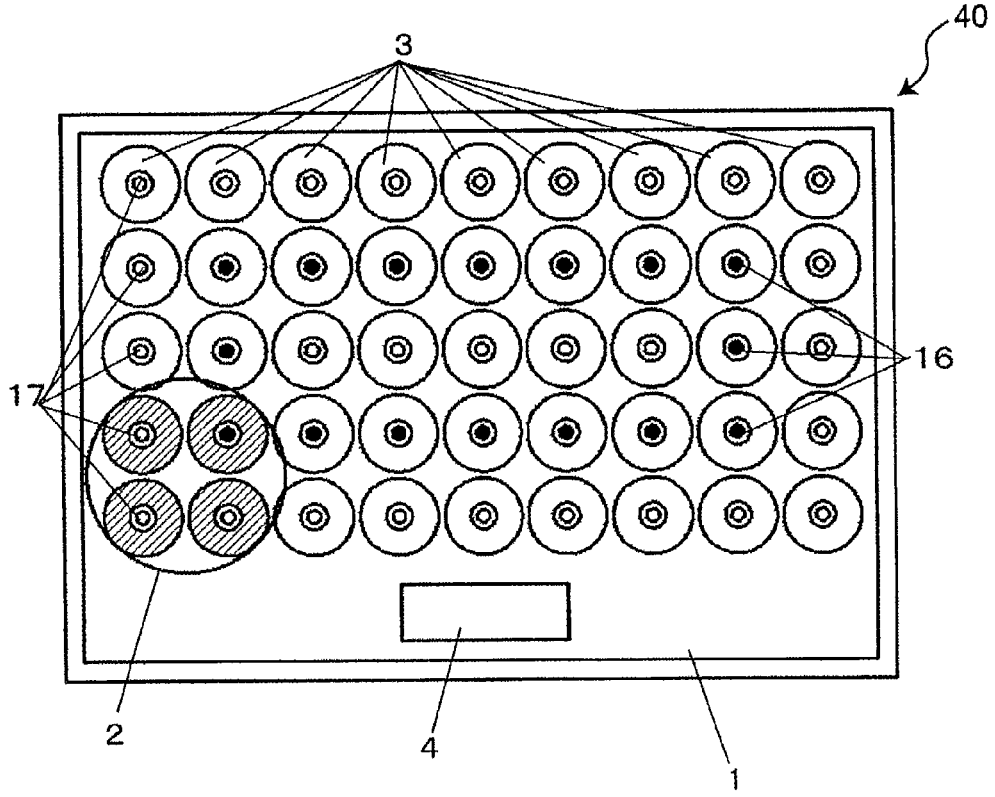
FIG. 7 is a top plan view of an induction heating cooker according to a third embodiment of the present invention as viewed from an upper surface of a top plate on which an object to be heated is placed, showing an arrangement of a number of heating coils and a number of infrared sensors.
Figure 8:
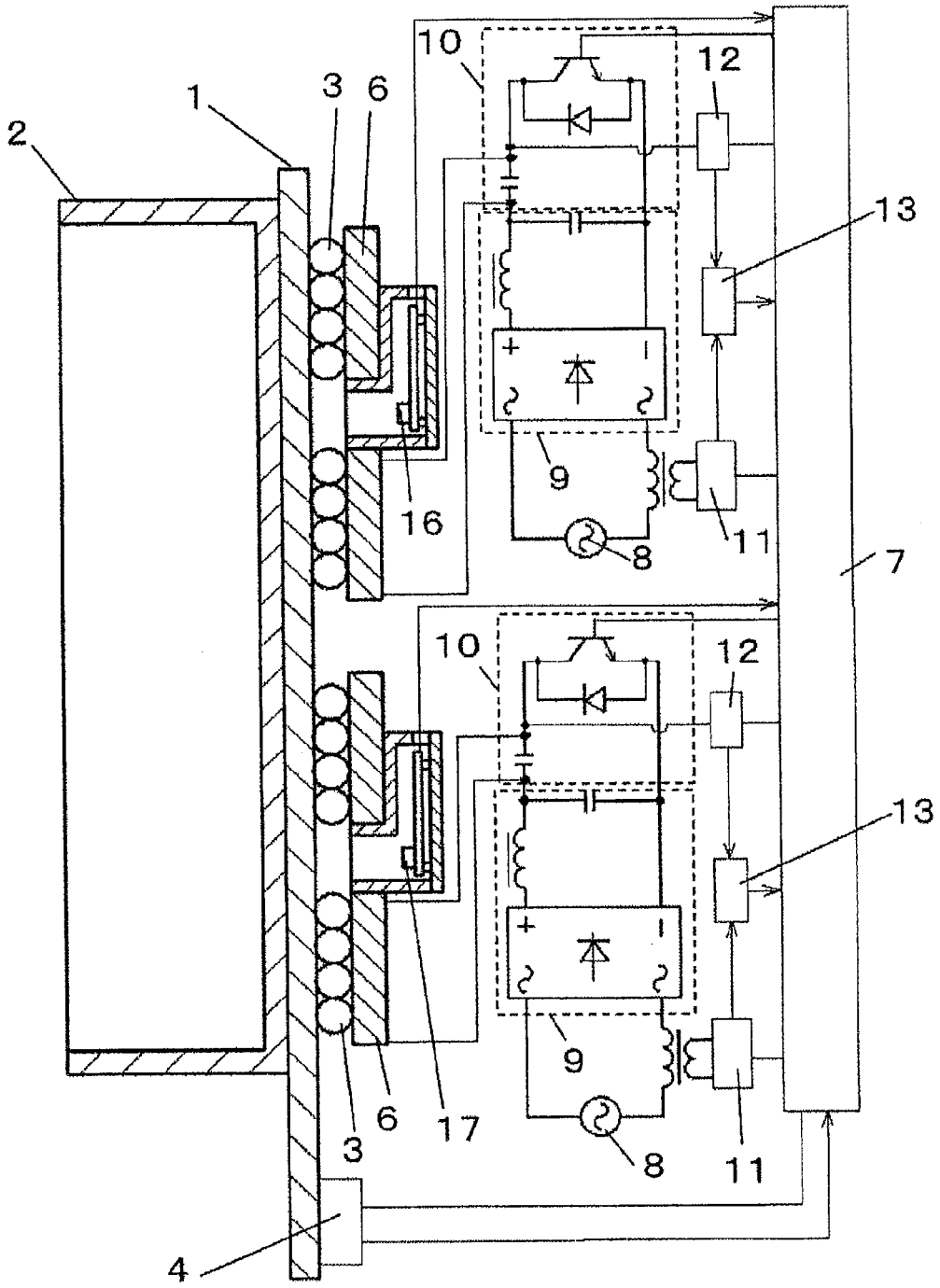
FIG. 8 is a block diagram showing a partial cross-sectional configuration and a circuit configuration of the induction heating cooker according to the third embodiment.

FIG. 7 is a top plan view of an induction heating cooker according to a third embodiment of the present invention as viewed from an upper surface of a top plate on which an object to be heated is placed, showing an arrangement of a number of heating coils and a number of infrared sensors employed as an example of a temperature detector. FIG. 8 is a block diagram showing a partial cross-sectional configuration and a circuit configuration of the induction heating cooker according to the third embodiment.

The induction heating cooker 40 according to the third embodiment differs from the induction heating cooker 20 according to the first embodiment referred to above in that a plurality of infrared sensors are disposed in such a manner that at least two infrared sensors having different detection temperature ranges are present below an object to be heated.

A crystallized glass used for the top plate 1 has a transmittance of about 90% in, for example, a wavelength range of 0.5-2.5 μm and, accordingly, infrared rays of this wavelength range emitted from the object to be heated 2 pass through the top plate 1 and are detected by the infrared sensors.

The infrared sensors include thermal type ones and quantum type ones. Although the quantum type infrared sensors are faster in response speed and higher in sensitivity than the thermal type infrared sensors, the former have a spectral sensitivity of a narrow wavelength range because they are made up of semiconductor elements. Accordingly, the quantum type infrared sensors have different sensitive temperature ranges depending on the kind of quantum types.

If the quantum type infrared sensors are made up of compound semiconductors, the sensitivity wavelengths can be changed by changing the composition or composition ratio. The infrared sensors output a signal proportional to the amount of infrared energy detected thereby, i.e., a signal proportional to the fourth power of the temperature of the object to be heated 2 in accordance with the Stefan-Boltzmann law.

Because an AD converter for converting a voltage of 0-5V at a resolution of, for example, 10 bits is generally used to detect the voltage of a voltage signal used in the appliance, the range is narrow and saturates with a temperature change of about 50-100K.

Also, the amount of infrared energy emitted from an object is determined by the temperature thereof and increases and is extended on a short-wavelength side with an increase in temperature.

For this reason, in the third embodiment, a range of 80° C.-250° C. is divided into two and a low-temperature detection range of 80° C.-150° C. is detected by low-temperature detecting infrared sensors 16, in each of which a detector element InAs having a detection wavelength of 1-3.5 μm is employed, while a high-temperature detection range of 150° C.-250° C. is detected by high-temperature detecting infrared sensors 17, in each of which a detector element Si having a detection wavelength of 0.3-1.1 μm is employed. That is, two kinds of infrared sensors having different detection temperature ranges are used as the infrared sensors employed as an example of the temperature detectors.

The infrared sensors 16, 17 are disposed below the centers of respective heating coils 3 and screwed to respective heating coil holders 6 so as to monitor through a roughly central portion of the heating coils 3. Each of the infrared sensors is integrated with one of the heating coils to form a heating coil unit.

Of the heating coils 3 arrayed in the longitudinal and transverse directions, the heating coils 3 arrayed on the outermost periphery are each provided with a high-temperature detecting infrared sensor 17 having a high-temperature detection range. Also, the heating coils 3 arrayed inside and adjacent to the outermost periphery are each provided with a low-temperature detecting infrared sensor 16 having a low-temperature detection range, and the heating coils 3 arrayed further inside them are each provided with a high-temperature detecting infrared sensor 17 having a high-temperature detection range.

In the third embodiment, a configuration in which nine columns of heating coils 3 and five rows of heating coils 3 are respectively arrayed in the longitudinal direction and in the transverse direction has been taken as an example, but with an increase in the number of the heating coils 3 in the longitudinal and transverse directions, a configuration in which a plurality of infrared sensors having different temperature detection ranges are alternately arrayed inward from the outermost periphery is employed.

The operation and function of the induction heating cooker 30 of the above-configuration are explained hereinafter.

As shown in FIG. 7, a user first places an object to be heated 2 on the top plate 1 so that three outermost heating coils 3 and one heating coil 3 inside them may be positioned below the object to be heated 2. Each object detector 13 causes a weak detection signal to flow through a corresponding one of all the heating coils 3 to detect whether a load is present or absent above the corresponding heating coil 3, based on a change in current detected thereby.

If a determination is made that an object to be heated 2 has been placed on a location substantially above two or more adjacent heating coils 3 and that, of the two or more adjacent heating coils 3, at least one high-temperature detecting infrared sensor 17 for detecting the high-temperature detection region and at least one low-temperature detecting infrared sensor 16 for detecting the low-temperature detection region are present, the controller 7 displays on the operation display 4 a message indicating that the object to be heated 2 has been placed and the heating can be started to urge the user to start heating.

The heating coils 3 having respective infrared sensors 16 for detecting the low-temperature detection region and those having respective infrared sensors 17 for detecting the high-temperature detection region are all registered in a microcomputer of the controller 7 in advance. When the user performs a heating start operation, high-frequency magnetic fields are generated by a plurality of heating coils 3 located below the object to be heated 2 so that the object to be heated 2 may be heated by eddy currents caused by the high-frequency magnetic fields.

When the temperature of the object to be heated 2 is increased by the heating, infrared rays corresponding to the temperature are emitted from a bottom surface of the object to be heated 2. In general, the infrared energy emitted from an object is determined by the temperature of the object and also increases and is extended on a short-wavelength side with an increase in temperature.

If the temperature of the object to be heated 2 ranges from 80° C. to 150° C., the infrared radiant energy of a wavelength range not greater than about 2.5 μm enters the low-temperature detecting infrared sensors 16, in which an InAs having a detection sensitivity at wavelengths of 1-3.5 μm is employed to detect the low-temperature detection range, and respective detection outputs are inputted to the controller 7, which in turn estimates the temperature of the object to be heated 2.

Also, if the temperature of the object to be heated 2 ranges from 150° C. to 250° C., the infrared radiant energy of a wavelength range not greater than about 1 μm enters the high-temperature detecting infrared sensors 17, in which an Si having a detection sensitivity at wavelengths of 0.3-1.1 μm is employed to detect the high-temperature detection range, and respective detection outputs are inputted to the controller 7, which in turn estimates the temperature of the object to be heated 2.

This is because the input energy to the infrared detecting elements contributes to the emissivity represented by Planck's law. In this way, the temperature of the object to be heated 2 can be detected widely.

As described above, the quantum type infrared sensors used in the third embodiment are faster in response speed and higher in sensitivity than other infrared sensors, but the former have a spectral sensitivity of a narrow wavelength range because they are made up of semiconductor elements. Part of the quantum type infrared sensors are employed as low-temperature detecting infrared sensors 16 for detecting a low-temperature detection range of 80° C.-150° C. and others are employed as high-temperature detecting infrared sensors 17 for detecting a high-temperature detection range of 150° C.-250° C. That is, the infrared sensors are arrayed so that at least two infrared sensors 16, 17 having different temperature detection ranges may be present below an object to be heated 2. By doing so, the infrared sensors 16, 17 having respective temperature detection ranges complement each other to work in respective temperature ranges sensitive to infrared rays, thereby making it possible to realize wide and highly sensitive temperature detection with respect to the object to be heated 2 placed above them. Accordingly, varying styles of cooking such as, for example, low-temperature cooking, cooking by frying, cooking by grilling and the like can be performed at a proper temperature to thereby enhance the usability.

Also, because the temperature of the object to be heated 2 can be detected more accurately and controlled so as not to abnormally heat the object to be heated 2, the safety can be enhanced.

Further, the infrared sensors mounted to the outermost heating coils 3 have the high-temperature detection range and the infrared sensors mounted to the heating coils 3 inside them have the low-temperature detection range. By this configuration, when an object to be heated 2 is placed above the outermost heating coils 3, temperatures in the high-temperature range can be accurately detected using the infrared sensors 17 having the high-temperature detection range. Accordingly, the object to be heated 2 can be controlled so as not to be abnormally heated at the periphery of the appliance, thereby making it possible to prevent seasonings, materials for cooking, kitchen utensils and the like placed around the appliance from being excessively thermally affected and to further enhance the safety.

Also, in the third embodiment, two kinds of infrared sensors having different temperature detection ranges are used, but the number of installation of each kind of infrared sensors can be made lesser than the number of the heating coils, thus making it possible to reduce the appliance cost.

Embodiment 4

Figure 9:
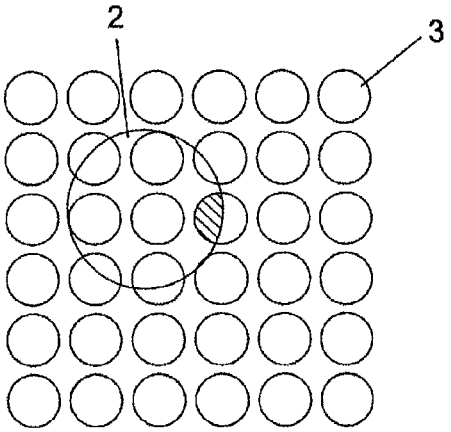
FIG. 9 is a perspective view showing a positional relationship between a pan and heating coils of an induction heating cooker according to a fourth embodiment of the present invention.

FIG. 9 is a perspective view showing a positional relationship between a pan (an example of an object to be heated) and heating coils of an induction heating cooker according to a fourth embodiment of the present invention. The fourth embodiment is an embodiment in which the size of a plurality of heating coils 3 arrayed in the above-described first to third embodiments is referred to. Accordingly, the heating coils 3 according to the fourth embodiment are applicable to the induction heating cookers according to the above-described first to third embodiments.

In FIG. 9, the plurality of heating coils 3 are arrayed widely below a top plate (not shown) and each of the heating coils 3 is formed into a spiral coil (that is, a circular coil) and has an external diameter of 50 mm. A pan 2 that is an example of the object to be heated is placed on the top plate (not shown). Although pans have a variety of shapes and sizes, those used most frequently have an external diameter of at least 150 mm. FIG. 9 depicts a pan having an external diameter of 150 mm.

Figure 10:
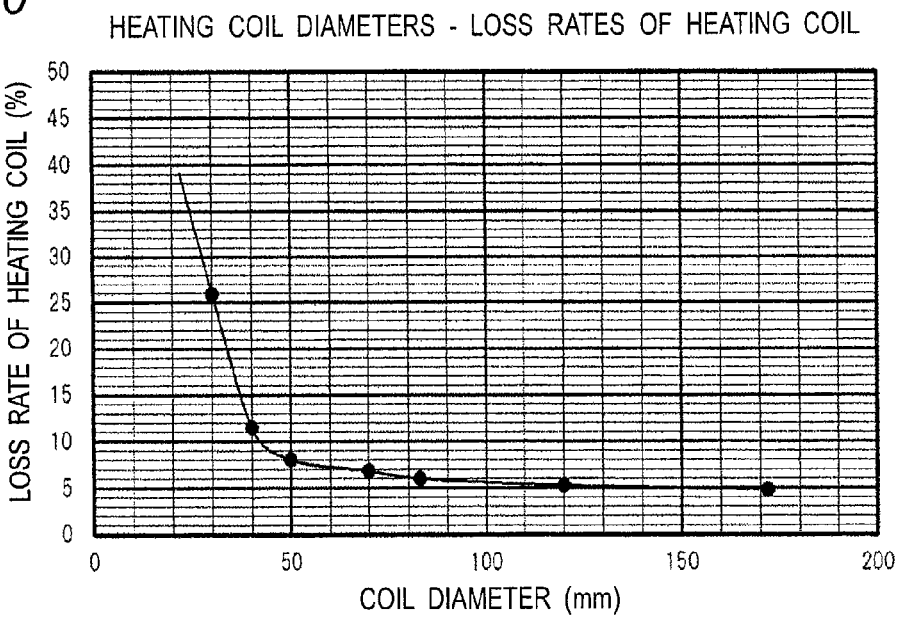
FIG. 10 is a graph showing a relationship between coil diameters and loss rates of the heating coils of the induction heating cooker according to the fourth embodiment.
Figure 11:
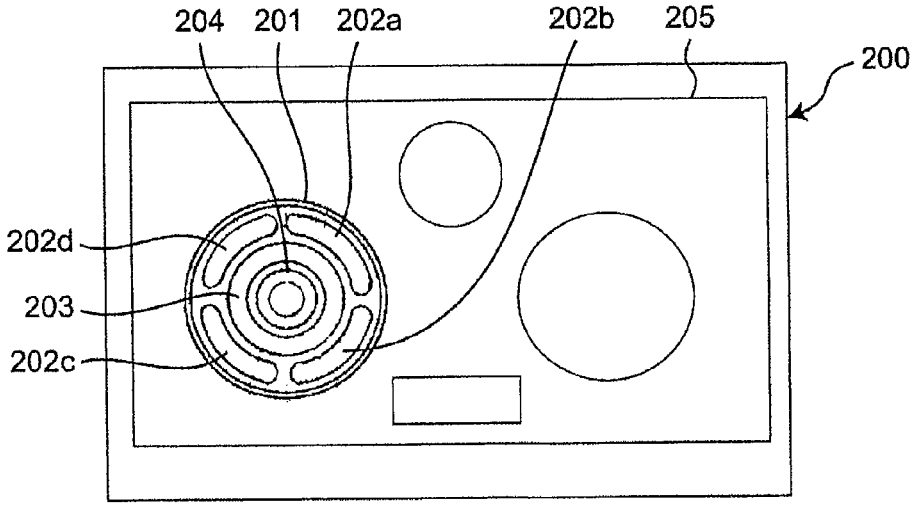
FIG. 11 is a top plan view of a conventional induction heating cooker as viewed from an upper surface of a top plate, showing an arrangement of heating coils.
Figure 12:
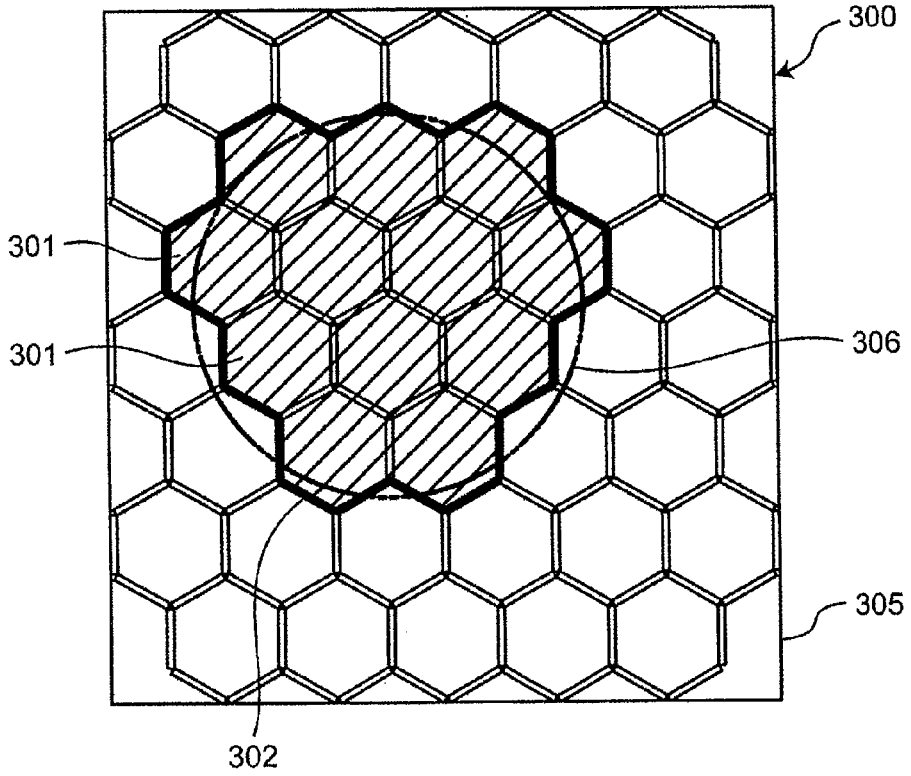
FIG. 12 is a view of another induction heating cooker, showing a state where an object to be heated has been placed and whole profiles of individual heating units in a heating region have been illuminated.

FIG. 10 is a graph showing a relationship between coil diameters and loss rates of the heating coils 3 of the induction heating cooker according to the fourth embodiment.

As shown in FIG. 10, when a heating coil 3 and a pan 2 are expressed by an equivalent circuit of an inductor of an inductance Ls and a resistor of a resistance value Rs and when the resistance Rs of the heating coil 3 with no pan 2 placed is indicated by Rs (no pan) and the resistance Rs of the heating coil 3 with the pan 2 placed is indicated by Rs (pan present), the heating coil loss rate is indicated by Rs (no pan)/Rs (pan present) and is a parameter indicating the heating efficiency of the heating coil 3.

The top plate is made of a crystallized glass having a thickness of 3-4 mm and intended to hold a pan 2 placed thereon. In the fourth embodiment, the distance between a bottom of the pan 2 and a surface of the heating coil 3 is set to 4.3 mm. The coupling between the pan 2 and the heating coil 3 becomes worse with a reduction in coil external diameter of the heating coil 3 and, hence, in order to compensate for it, the inductance is increased by increasing the number of coil turns of the heating coil 3.

However, this results in an increase in thickness of the heating coil 3 itself, which in turn substantially increases the distance (for example, the average distance) between the heating coil 3 and the pan 2. Accordingly, the worsening of the coupling cannot be compensated for. As a result, the heating coil loss rate increases rapidly, followed by a reduction in heating efficiency. In order to produce an induction heating cooker using such a heating coil, the heating coil loss rate is required to be within at least 20%.

As shown in FIG. 10, if the coil external diameter of the heating coil 3 is not greater than 35 mm, the heating coil loss rate increases rapidly and exceeds 20%. The coil external diameter of the heating coil 3 is required to be 35 mm or more in order for the induction heating cooker to curb the heating coil loss rate below 20%.

Also, as shown in FIG. 9, in the induction heating cooker according to the fourth embodiment, a plurality of heating coils 3 are arrayed widely below the top plate and those of the heating coils 3 on which the pan 2 has been placed are identified by causing a detection current to flow through each of the heating coils 3 so that the identified heating coils 3 may be supplied with a high-frequency current. By doing so, any of a variety of pans can be placed on an arbitrary position of the top plate for induction heating.

A heating coil 3 positioned below the center of the pan 2 is supplied with electricity by detecting that the pan 2 has been placed thereon, but whether or not the pan 2 has been placed on a heating coil 3 positioned below the periphery of the pan 2 is determined depending on the degree of overlap between the pan 2 and the heating coil 3.

A reasonable criterion for determination is whether or not about half of the heating coil 3 overlaps with the pan 2.

Such a criterion for determination is based on the degree of overlap between the pan 2 and the heating coil 3 positioned below the periphery of the pan 2 and, as indicated by oblique lines in FIG. 9, if a heating coil positioned below the pan overlaps with the pan to a degree slightly less than half the heating coil, this heating coil 3 is supplied with no electricity.

For this reason, a portion of the pan 2 indicated by the oblique lines in FIG. 9 is not induction heated and is accordingly reduced in temperature, and a temperature difference occurs between this portion and other portions of the pan 2, thus giving rise to uneven cooking. The influence of this uneven cooking increases with a reduction in pan diameter relative to the coil diameter of the heating coil 3. In other words, the influence increases with an increase in coil diameter relative to the pan diameter.

In the case where a pan with a diameter of 150 mm, an example of a small diameter, having the most influence in view of the frequency of use is used, if the area of the portion indicated by the oblique lines in FIG. 9, i.e., the area of half a surface of the heating coil 3 confronting the pan 2 is not greater than 10% of the pan bottom surface area, uneven cooking can be reduced to a level of little concern.

If the coil external diameter of the heating coil 3 is 67 mm, half of the area of the surface of the heating coil 3 confronting the pan 2 is 1,763 $mm^2$ and not greater than 10% of a bottom area 17,671 $mm^2$ of the pan diameter of 150 mm.

As described above, by setting the coil external diameter of the heating coil 3 to range from 35 mm to 67 mm, even if an object to be heated such as a cooking container of varying size is placed on an arbitrary position of the top plate for induction heating, not only can uneven cooking be reduced, but an induction heating cooker having a high heating efficiency can be also provided. A heating coil 3 having an external diameter of 35 mm or 67 mm has a circumferential length of 110 mm or 210 mm, respectively.

Although in the fourth embodiment the heating coil has been described as being in the form of a spiral (circle), if a heating coil has a circumferential length in the range (generally in the range from 110 mm to 210 mm) corresponding to the external diameter range of the circular heating coil as set forth in the fourth embodiment, a heating coil in the form of another shape such as, for example, an ellipse, a square or a triangle can naturally produce similar effects. The reason for this is that because the nature of the heating coil has a relationship with the number of coil turns, heating coils of the same circumferential length generally have the similar nature irrespective of their shapes.

Although in the embodiments referred to above a configuration in which a plurality of heating coils 3 are arrayed below the top plate in the longitudinal and transverse directions has been taken as an example, the heating coils 3 may be arrayed in varying patterns. It is sufficient if the plurality of heating coils 3 are arrayed in a plurality of directions crossing each other. By way of example, the plurality of heating coils 3 may be arrayed in the longitudinal direction and in an oblique direction or in oblique directions crossing each other. Also, the heating coils may be each in the form of a hexagon and all arrayed in the form of a honeycomb shape so that sides of one hexagon may be each adjacent to one side of a different hexagon. In any case, it is sufficient if the plurality of heating coils are arrayed uniformly and widely in a regular pattern and, accordingly, a variety of configurations can be employed.

Also, a configuration in which a plurality of heating coils 3 are disposed in the longitudinal and transverse directions and a plurality of infrared sensors 5 are disposed below the centers of alternate heating coils 3 in the longitudinal and transverse directions has been taken as an example, but various other configurations may be employed if the number of installation of the infrared sensors 5 is less than the number of the heating coils 3. By way of example, a configuration in which each infrared sensor 5 is disposed below the center of every other heating coil 3 in at least one of a plurality of directions crossing each other may be employed.

Further, in a configuration in which the infrared sensors 5 are disposed only outside the heating coils 3, each infrared sensor 5 may be disposed at a location equally spaced from at least three adjacent heating coils 3. In this configuration, because each infrared sensor 5 can be related to the three heating coils 3, the temperature of an object to be heated 2 placed above any of the three heating coils 3 can be accurately detected by the adjacent infrared sensor 5 related thereto. In the configuration shown in FIG. 5, each infrared sensor 5 is disposed at a location equally spaced from four heating coils 3.

Also, each infrared sensor 5 may be disposed at a remove from the location equally spaced from at least three adjacent heating coils 3. In this configuration, the infrared sensor 5 can be related to the nearest heating coil 3 of the three heating coils 3 and the temperature of the object to be heated 2 can be accurately detected using the infrared sensor 5 related to the heating coil 3 on which the object to be heated 2 has been placed.

In addition, each infrared sensor 5 may be disposed between two adjacent heating coils 3. In this configuration, the infrared sensor 5 can be related to the two adjacent heating coils 3 and the temperature of the object to be heated 2 can be accurately detected using the infrared sensor 5 related to the heating coils 3.

As described above, the induction heating cooker according to the present invention includes a number of heating coils, some of which are determined by a user to place an object to be heated thereon, and the heating coils on which the object to be heated has been placed are first detected and only such heating coils are subsequently activated. In this configuration, the temperature of the object to be heated can be accurately detected by the temperature detectors and, hence, the present invention is effective for an induction heating cooker having a number of heating coils.

Any combination of the various embodiments referred to above can produce respective effects.

Although the present invention has been fully described by way of preferred embodiments with reference to the accompanying drawings, it is to be noted here that various changes and modifications will be apparent to those skilled in the art. Therefore, unless such changes and modifications otherwise depart from the scope of the present invention as set forth in the appended claims, they should be construed as being included therein.

What is claimed is:

1. An induction heating cooker comprising:

a top plate supporting an object;

a plurality of heating coils adjacent to one another below the top plate and configured to generate inductive magnetic fields to heat the object;

a plurality of temperature detectors operable to detect a temperature of the object, wherein the plurality of heating coils are arrayed in a plurality of directions crossing each other and the temperature detectors are mounted to alternate heating coils in one of the plurality of directions; and a controller configured to control operating states of the heating coils based on detection results of the temperature detectors, wherein the plurality of temperature detectors are disposed widely below the top plate such that:

at least one of the temperature detectors resides below the object when the object resides above two adjacent heating coils, wherein the temperature detectors are each mounted to a central portion of one of the heating coils, and at least one of the two adjacent heating coils has no temperature detector; and the number of the temperature detectors is less than the number of the heating coils.

2. The induction heating cooker according to claim 1, wherein each of the heating coils has a circumferential length within a range of a circumferential length of a circle having an external diameter that ranges from 35 mm to 67 mm.

* * * * *